US005569099A

United States Patent [19]

Jackson

[11] Patent Number: 5,569,099

[45] Date of Patent: Oct. 29, 1996

[54] GOLF CLUB SHAFT AND LAMINAR STRUCTURAL ELEMENT AND METHOD FOR ITS MANUFACTURE

[76] Inventor: Al Jackson, 2590 Pioneer Ave., Vista, Calif. 92083

[21] Appl. No.: 366,965

[22] Filed: Dec. 30, 1994

[51] Int. Cl.[6] ..... A63B 53/10

[52] U.S. Cl. ..... 473/319; 473/318

[58] Field of Search ..... 273/80 B, 80 A, 273/80 R, 80 C, DIG. 7, DIG. 23; 156/187, 188, 189, 190

[56] References Cited

U.S. PATENT DOCUMENTS

| | | | |
|---|---|---|---|
| 4,082,277 | 4/1978 | Van Auken et al. . | |
| 4,097,626 | 6/1978 | Tennent . | |
| 4,135,035 | 1/1979 | Branen et al. | 273/80 B |
| 4,889,575 | 12/1989 | Roy | 273/80 B |
| 5,088,735 | 7/1992 | Shigetoh | 273/80 B |
| 5,093,162 | 3/1992 | Fenton et al. . | |
| 5,265,872 | 11/1993 | Tennent et al. . | |
| 5,316,299 | 5/1994 | Feche et al. . | |
| 5,326,099 | 7/1994 | Yamamoto et al. | 273/80 B |
| 5,385,767 | 1/1995 | Noguchi | 273/80 B |

FOREIGN PATENT DOCUMENTS

| | | |
|---|---|---|
| 2673570 | 9/1992 | France . |
| 52-94368 | 8/1977 | Japan . |
| 55-25345 | 2/1980 | Japan . |
| 62-59030 | 3/1987 | Japan . |
| 4-50901 | 2/1992 | Japan . |
| 4-68029 | 3/1992 | Japan . |
| 4-327925 | 11/1992 | Japan . |
| 1446444 | 8/1976 | United Kingdom . |

*Primary Examiner*—Steven B. Wong

*Attorney, Agent, or Firm*—Kolisch, Hartwell, Dickinson, McCormack & Heuser

[57] ABSTRACT

A low-torque lightweight shaft and a laminar structural element and method for its manufacture are described. The invented shaft is fabricated by fabricating a laminar structural element in the form of a planar sheet or blank patterned and sized for spirally, rather than helically, wrapping around a mandrel. The laminar structural element preferably includes oppositely angularly biased plies interposed by a longitudinally or "zero" oriented ply of any suitable binder-containing, oriented boron or carbon fiber-filled polyacrylonitrile (PAN) sheet material. Preferably, another zero orientation ply, prior to wrapping, is placed above one of the bias plies, thereby ensuring complete separation of the opposing bias plies in the finished shaft. Typically, each ply is approximately 4–6 mils thick and the overall wall thickness of the wall of the finished shaft is approximately 30 mils, rendering the shaft approximately 30% thinner, and significantly lighter in weight, than conventional shafts. Nevertheless, the shaft is because of its unique laminar construction more torque resistant and less subject to shear than those of conventional, helically wrapped, laminar construction. The shaft may be fabricated otherwise by methodology means, whether manual or automated.

17 Claims, 1 Drawing Sheet

GOLF CLUB SHAFT AND LAMINAR STRUCTURAL ELEMENT AND METHOD FOR ITS MANUFACTURE

BACKGROUND AND SUMMARY OF THE INVENTION

This invention relates generally to low-torque, lightweight shafts. More particularly, it concerns an improved shaft, and a laminar structural element and method for its manufacture, the shaft being substantially more durable, yet lighter in weight, than conventional shafts.

Golfers and promoters know that yardage is everything, and that even a few extra yards' distance on a drive may mean the difference in a tournament between a win and a loss. The most significant factor in drive distance for a particular golfer is the leverage obtainable by the golf club's shaft. The lighter the shaft, the more weight that can be added to the head, which on the pro circuit may be traveling in excess of 100 miles per hour (mph) when it strikes the ball. Consequently, the power impacting on the ball by the club's head may be greatly increased by lightening the shaft. (Even when the club is traveling far slower during the golfer's downswing, the club preferably would exhibit proper balance, would flex controllably and would resist torsion, or twisting of the head about the shaft's long axis.) The shaft must flex just so during the backswing and downswing in order to impart the greatest possible angular momentum to the club's head as it strikes the ball. Accuracy is dependent in large part by the torsional resistance of the shaft to twisting during the swing, which can result in pulling or slicing the ball. Flexural performance and torsional resistance in the golf club's shaft require a delicate balance in terms of structural requirements.

Previously, golf club shafts have been made by helically wrapping binder-containing fiber material, e.g. graphite, strips around an armature, e.g. a stainless steel mandrel, to form a slightly tapered, but generally cylindrical, hollow tube and heating the structure to bond the wrapped layers into an integral tubular structure. Polyurethane paints typically are used to coat the bonded structure and the coated structure is polished to produce a finished shaft for assembly into a golf club. It has been suggested that, for resisting the torsional forces incident upon the shaft when the club's head strikes the ball, helical material strips should be biased at an angle transverse to the shaft's long axis, and that preferably alternate strips should be biased at opposite and equal angles of between approximately 20° and 45°. One known patent disclosure suggests adding a singular unbiased, or zero orientation graphite laminate as a middle layer of the shaft's substantially biased-laminar structure. This construction is described and illustrated in U. K. Patent No. 1 446 444, entitled SHAFTS FOR GOLF CLUBS, which was published Aug. 18, 1976, with which familiarity is assumed.

Briefly, the invented golf shaft is fabricated by fabricating a laminar structural element in the form of a planar sheet or blank patterned and sized for spirally, rather than helically, wrapping around a mandrel. The laminar structural element preferably includes oppositely angularly biased plies interposed by a longitudinally or "zero" oriented ply or any suitable pre-impregnated, continuous-fiber material such as boron or carbon-based sheet material such as polyacrylonitrile (PAN). Preferably, another zero orientation ply, prior to wrapping, is placed above one of the bias plies, thereby ensuring complete separation of the opposing bias plies in the finished shaft. Typically, each ply is approximately 0.004–0.006 inch (4–6 mils) thick, producing a laminate, or sandwich, material that is approximately 10–15 mils thick that, when rolled onto a mandrel produces a hollow shaft having an overall wall thickness of approximately 30 mils, rendering the shaft approximately 30% thinner, and significantly lighter in weight, than conventional shafts. Nevertheless, the shaft is because of its unique laminar construction more torque resistant and less subject to shear than those of conventional, helically wrapped, laminar construction. The shaft may be fabricated otherwise by conventional means, whether manual or automated.

The principal object and advantage of the invention is to produce a golf club shaft having a greater stiffness to weight ratio (i.e. effective modulus of elasticity). The invention involves a construction requiring less material to achieve the same stiffness and torque rating as that of much heavier shafts, e.g. 90–100 grams or more. Because there is less material in the construction, the shaft that is of lighter weight, e.g. approximately 50 grams, yet exhibits superior performance than, prior constructions.

These and additional object and advantages of the present invention will be more readily understood after a consideration of the drawings and the detailed description of the preferred embodiment.

DETAILED DESCRIPTION OF THE PREFERRED EMBODIMENT

Figure 1:
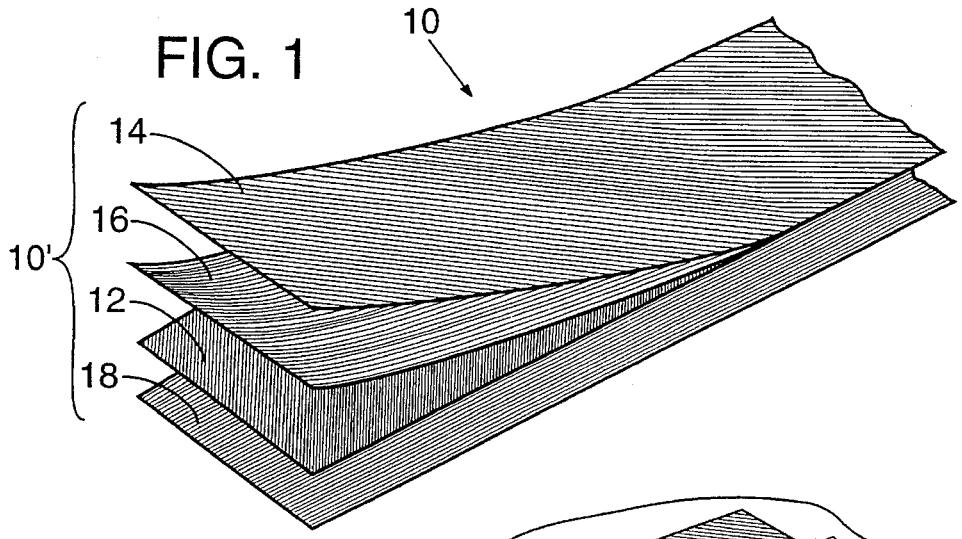
FIG. 1 is an isometric fragmentary view of the invented golf shaft laminar structure in a slightly splayed configuration that illustrates the various plies and their orientations.

Referring first to FIG. 1, the invented laminar structure is indicated in an isometric view at 10. Preferably, structure 10 includes three substantially coextensive planar plies of an binder-containing fiber sheet material the outline of which is patterned as an elongate trapezoid that, when spirally wound, forms a slightly frusto-conical, but substantially cylindrical, hollow tube. A first bias ply 12 preferably orients the fiber sheet material at an angle transverse to the long axis of laminar structure 10. A second bias ply 14 preferably orients the fiber sheet material at an opposite but substantially equal transverse angle to the long axis of laminar structure. Typically, such angles-which are illustrated in FIG. 1 by hatched lines-may be approximately ±45°, although those of skill in the art will appreciate that the invented shaft and laminar structural element is not so limited but instead may be characterized by other suitable bias angles, within the spirit and scope of the invention. The ±45° angles, it will be appreciated, produce a 90° angle between the bias plies, which is believed optimally to produce a shaft capable of resisting bidirectional torsional forces that otherwise might permit the shaft and head to twist, one direction or another, ever so slightly.

An important feature of the invented laminar structure is a first zero-orientation ply 16 that is coextensive with and interposes first and second bias plies 12, 14. First zero-orientation ply 16, the fiber grain of which is understood to run substantially parallel with the long axis of laminar structure 10, preferably is of the same material content, and may be of the same material thickness, as two outer bias plies 12, 14. The three plies of sheet material may be tacked together for ease of handling by the application of heat, as by ironing with a moderately hot iron. This application of heat tacks the adjacent mating surfaces of adjacent plies as the epoxy increases in temperature and becomes more fluidic. While a variety of sheet materials may be used to form laminar structure 10, in accordance with the preferred embodiment of the invention, sheets of binder-containing (e.g. epoxy-impregnated) oriented carbon or graphite fiber-filled material of a suitable thickness and flexibility has been found to work well. As will be seen, a material thickness of approximately 4–6 mils has been determined to provide sufficient flexibility and strength. It will be appreciated by persons skilled in the art that the dimensions and weights given herein as being preferable are for irons, and that shafts for incorporation in woods may be of somewhat smaller dimension and weight, whether by using thinner laminar sheet material or by spirally winding fewer layers thereof. In any event, different material contents, dimensions and masses are contemplated and are within the spirit and scope of the invention.

Importantly, first interposing ply 16 between bias plies 12, 14 substantially completely separates these two oppositely biased plies from one another. This has been found significantly to increase the torsional resistance and overall strength of a hollow shaft made from laminar structure 10. This is believed to be due to the tendency of adjacent and contacting, oppositely biased plies to interfere with, or perhaps partially cancel one another's torsional resistance. Equally importantly, the fibers within interposed ply 16 are oriented at an angle which is preferably substantially, and most preferably exactly, half way between the opposing angles at which the fibers within first and second plies 12, 14 are oriented. This is believed optimally to separate the torsional forces exerted on the two outer bias plies, creating something of a neutral buffer zone. Of course, zero-orientation ply 16 also provides the important flexural response of a golf club shaft made from laminar structure 10 because the orientation of its fibers is preferably substantially, and most preferably, exactly, parallel with the long axis of the golf club shaft, as will be seen by reference to FIG. 2.

Summarizing the invented laminar structure, now, it may be seen that laminar structure 10, suitable for forming into a generally cylindrical hollow shaft, preferably includes a first angularly biased fiber ply 12 of substantially planar flexible binder-containing sheet material of predefined elongate rectilinear shape, and a second angularly biased fiber ply 14 of substantially planar flexible binder-containing sheet material of predefined elongate rectilinear shape, wherein first and second biased fiber plies 12, 14 are oriented such that their angular bias is substantially equal but opposite one another. Laminar structure 10 also preferably includes a first longitudinally oriented fiber ply 16 of substantially planar flexible binder-containing sheet material of predefined elongate rectilinear shape. In accordance with invention, such first longitudinally oriented fiber ply 16 preferably is lying in interposed relationship between first and second angularly biased fiber plies 12, 14 in substantially coextensive relationship therewith, as is perhaps best shown in FIG. 1.

First and second biased fiber plies 12, 14 each may be seen to be bonded to first longitudinally oriented fiber ply 16 as by the described heating step of the invented method, to be described in detail below, thereby to cause the impregnated epoxy to flow into interstitial gaps within the mating plies 12, 14, 16. Most preferably, laminar substructure 10 is enhanced for its performance in golf club shaft 24 by further including therein a second longitudinally oriented fiber ply 18 of substantially planar flexible binder-containing sheet material of predefined elongate rectilinear shape. Such second longitudinally oriented fiber ply 18 lies preferably in coextensive relationship with either one of first and second biased fiber plies 12, 14. It also lies, as may be surmised from FIGS. 1 and 2, in an orientation such that its longitudinal or zero-bias is parallel with that of first longitudinally oriented fiber ply 16.

Preferably, the resulting laminar structure 10' that includes plural coiled and overlapped lengths of the second longitudinally oriented fiber ply 18 as well as first longitudinally oriented fiber ply 16 has an overall wall thickness of less than approximately 30 mils, thereby producing a lightweight but appropriately flexibly strong and low-torque shaft 24 suitable for the most demanding golf venues. Those skilled in the art will appreciate that the invention is not limited to such wall thicknesses, or to such ply or laminar structural element thicknesses, or to any particular number of spiral windings, etc., although those described and illustrated herein have been found to produce exceptional performance in low-torque, lightweight shafts. As may be surmised from the above discussion of the preferred thicknesses of the various plies 12, 14, 16, 18, each is substantially approximately as thick as every other, e.g. each is preferably approximately between 4 mils and 6 mils thick. Also preferably the bias plies 12, 14 are biased approximately perpendicularly to one another, i.e. their ±45° angled fiber biases produce a 90° angle therebetween. Again, the invented laminar structural element for producing the invented golf shaft is not limited to such angles or orientations, although such are believed to be optimal for the presently available materials and stated performance objectives.

Figure 3:
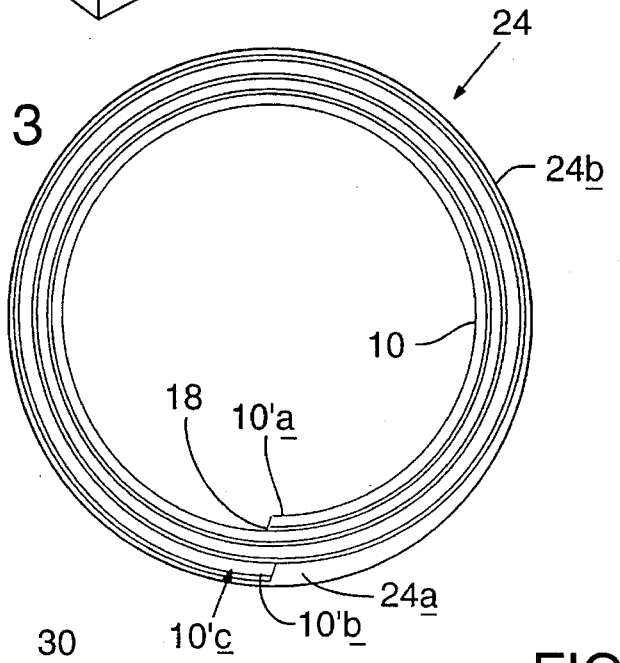
FIG. 3 is a greatly enlarged view of the end of the formed shaft in its wrapped condition after bonding, removal of the mandrel and coating of the shaft.

As may be seen from FIG. 3, radially adjacent segments of angularly biased plies 12, 14 preferably, but without limitation to the scope of the claimed invention, are separated by a longitudinally oriented ply segment of either ply 16 or ply 18 such that no first angularly biased ply contacts a second angularly biased ply, even when the originally planar, flexible laminar superstructure 10' is rolled such that adjacent circular segments overlap one another. This feature of the preferred embodiment of the invention produces unparalleled performance in a lightweight golf club shaft. The resulting tubular structure has an exposed outer surface, prior to finishing as by coating, that is a longitudinally or zero-oriented bias ply the longitudinal orientation of which is less subject to flaking, chipping, peeling that may otherwise result from handling or environmental influences impacting on the shaft during its manufacture a preferred method for which is next to be described.

Figure 2:
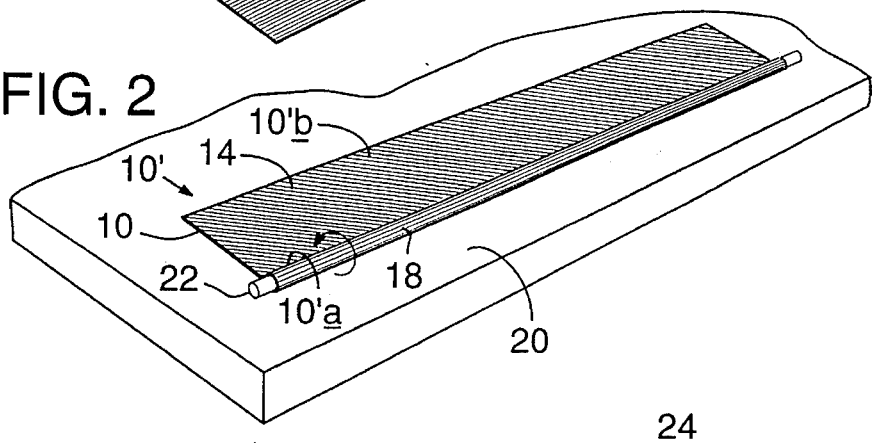
FIG. 2 illustrates a shaft-forming step of the preferred method of manufacturing the golf club shaft.

FIG. 2 illustrates the preferred method by which a golf club shaft is formed using laminar structure 10. It may be seen that preferably a second zero-orientation ply 18 similar to first zero-orientation ply 16 lies beneath, and is coextensive with, laminar structure 10, which may be supported on a work surface 10 as shown in FIG. 2. Second zero-orientation ply 18 may be of identical material, size, shape and texture as first zero-orientation ply 16. This preferred dimension and arrangement of laminar layers produces a balanced, alternate layering of bias and zero-orientational plies in a ratio of approximately 1:1, wherein further the radially spaced bias plies preferably are biased approximately 90° relative to one another and preferably are also in a ratio of 1:1. This 1:1:1:1 ratiometric ordered arrangement of 0°: +45°:00:–45° plies is believed to represent an optimum tradeoff between low-torque and high-flexing strength for high-performance golf shafts, although the invention is not so limited.

It is believed that the constituent performance in such a laminar structure due to the alternating-biases construction is more in unison or more structurally complementary than in conventional laminar structures where bias plies are sandwiched together in contact with one another or where plies of a given orientation are singular or plural ones thereof are either in contact with or are greatly separated from one another. It is also believed that the shear strength of such a laminar structure is greatly enhanced because of the alternately angled bias plies which plies lie transversely to one another preferably at a 90° angle. Such is achieved, in accordance with invention, without increasing the overall mass or thickness of the golf club shaft, whereas with conventional constructions, increasing the shear strength or torque resistance would have required the addition of material and resulting shaft wall thickness and mass.

It will be appreciated from FIGS. 1 and 2 that second zero-orientation ply 18 preferably mates first bias ply 14, which while not shown in FIG. 2 is shown in FIG. 1. It may be seen that, by spirally winding or rolling laminar structure 10 with second zero-orientation ply 18 therebelow around a mandrel 22, a thin-walled hollow tube may be formed that has second zero-orientational ply 18 forming the tube's exposed outer surface. This rolling or winding step in the method of manufacturing a golf club shaft is suggested by the elliptically curved arrow indicating the rolling direction of mandrel 22 atop work surface 20.

It will be appreciated by those of skill in the art that second zero-orientation ply 18, which is most preferably coextensive with laminar structure 10, maintains a radial separation, or spacing, between radially adjacent spiral segments of laminar structure 10 when it is formed with plural spiral windings as shown in a finished golf club shaft 24 illustrated in the greatly enlarged end view of FIG. 3 (wherein laminar structure 10 is illustrated as an integral laminate, for the sake of clarity). Again, it is preferable to substantially, and most preferably to completely, separate adjacent bias plies of opposite angular bias. It may be seen from FIGS. 2 and 3 that, were it not for second zero-orientation ply 18, first and second bias plies 12, 14 would be in substantial contact with one another because of an adjacency that results from plural-winding overlap. Importantly, in accordance with the preferred embodiment of the invented golf club shaft and method for its manufacture, a neutral, zero-orientation ply 18 prevents such contact, thereby avoiding any adverse structural effects of such contact. It will be appreciated that there yet is the possibility, due perhaps to flaws in the sheet material or hot flow of material within the sheet or cold flow during use, that slight contact between oppositely biased plies 12, 14 may occur, but such is substantially avoided by the teachings herein.

It will be appreciated that zero-orientation ply 18 alternatively may be placed atop laminar structure 10, or next to second bias ply 14 instead of next to first bias ply 12. As may be understood from the spiral winding depicted in FIG. 2, such would produce the same desirable non-contacting separation of bias plies 12, 14 because zero-orientation ply 18 would still would extend therebetween generally as indicated in FIG. 2. It is believed to be preferable, however to place zero-orientation ply 18 as indicated so that it forms the outer surface of spirally wound hollow tube 24, as this has been found to produce the desired low-torque, high-durability shaft and also to resist chipping, cracking and peeling during the handling thereof prior to the optional polyurethane coating step.

Referring still to FIG. 3, it may be seen that a method step in the manufacture of the invented golf club shaft involves heating the wound structure to cause high-temperature bonding between adjacent plies. Such bonding occurs at high temperature as the binder contained within each sheet material ply flows and fills interstices around the oriented fibers. The heating step may use conventional equipment, whether manual or automatic, e.g. ovens may be used. FIG. 3 also shows an outer coating **24*a* of the wound and bonded structure that may be applied to give the golf club shaft a finished and smooth look and feel. Preferably, coating 24*a* is of polyurethane, and may of course be a polyurethane paint, although those of skill in the art will appreciate that any suitable coating or none may be applied to shaft 24 within the spirit and scope of the invention. The outer surface of coated shaft 24** may be ground and polished as desired for smoothness, and one or more successive coating and polishing steps may be performed. The overall weight of a standard-length driver shaft is approximately 50 grams, which is approximately 30% lighter than comparable, so-called lightweight shafts of conventional construction and exhibiting comparable properties of flex and shear and torsional resistance.

The preferred method of the invention, by which a hollow and generally cylindrical shaft is produced, now will be summarized. It preferably includes 1) forming on a generally horizontal work surface 20 an elongate, generally planar laminar substructure 10 including a first and second outer oppositely angularly biased fiber plies 12, 14 having interposed therebetween a first longitudinally oriented fiber ply 16; 2) laying a second longitudinally oriented fiber ply 18 on one of the outer plies 12, 14 in substantially coextensive relationship therewith to form a laminar superstructure 10' having no more than one surface-exposed biased fiber ply (12); 3) positioning a generally cylindrical mandrel 22 on work surface 20 generally along a first edge **10'*a* of laminar superstructure 10'; 4) rolling onto mandrel 22 such laminar superstructure 10' to produce a generally cylindrical tube 24 formed of the laminar superstructure wherein a second edge 10'*b* of the laminar superstructure overlaps an inner rolled region 10'*c* thereof; 5) heating tube 24 to a sufficient temperature to bond the plies 12, 14, 16, 18 thereof to one another; and 6) smoothing an outer surface 2412 of the tube to produce a substantially circular generally cylindrical hollow shaft, indicated in FIG. 4 as shaft 24**.

Those of skill in the art will appreciate that the smoothing step may include coating tube 24 with a coating such as a polymeric coating, and preferably a polymer such as polyurethane coating **24*a*, curing such polymeric coating and polishing the cured polymeric coating to produce the smooth, circular cross section indicated in FIG. 3. The method preferably further includes 7) dimensioning laminar substructure 10 and second longitudinally oriented fiber ply 18 with sufficient width for the rolling step to produce plural overlapping substantially concentric cross-sectionally circular coils of such superstructure 10' as are best illustrated in FIG. 3**. Additional preliminary, intermediate or terminal steps are contemplated, as are charges to the ordering of the listed steps, and are within the spirit and scope of the invention.

The result of using the above invented method is the production of a low-torque, lightweight golf club shaft that includes a generally cylindrical, elongate tube 24 of spirally wound and bonded laminar material 10 including two or more angularly biased fiber plies 12, 14 separated over their substantial spirally adjacent surface areas by one or more longitudinally oriented fiber plies such as interposing ply 16 and overlaid ply 18. Preferably, at least one of the one or more longitudinally oriented fiber plies 16, 18 interposes any two adjacent ones of the two or more angularly biased fiber plies over the substantial spirally wound length of the laminar material 10. This is best illustrated in FIG. 3, where it may be seen that, within laminar substructure 10, the two bias plies 12, 14 are interposed by longitudinal oriented ply 16, and that, within rolled and lapped laminar superstructure 10', adjacent, rolled, layered segments of laminar substructure 10 having otherwise exposed outer bias plies 12, 14 are separated by overlaid longitudinally oriented fiber ply 18.

As is clear from FIGS. 1 through 4, adjacent ones of angularly biased fiber plies 12, 14 are oppositely and substantially equally angularly biased, e.g. their biases extend at opposite and equal angles' symmetrically transversely relative to the bias of longitudinally oriented ply 16 and the resulting long axis of shaft 24. Preferably, the angularly biased plies 12, 14 and the longitudinally oriented fiber plies 16, 18 are carbon or graphite, although the invention is no so limited as it will be seen that any suitable material, e.g. boron, may be used within the spirit and scope of the invention. The most preferred material is thought to be a continuous-fiber material such as boron or carbon-filled polyacrylonitrile (PAN) sheet material containing a binding agent, or binder, of suitable preferably synthetic, polymeric material, e.g. epoxy, although it may also or instead include a light metal matrix such as one of aluminum (Al). Those of skill in the art will appreciate that any suitable binder capable of becoming fluidic as it increases in temperature and that is capable of acting as a bonding agent, or adhesive, will serve and that the invention is not limited to the preferred epoxy-impregnated, oriented carbon fiber-filled PAN sheet material.

When golf club shaft 24 is made in accordance with the preferred method of the invention of either listed or any other suitable material, the wall of tube 24 is less than approximately 40 mils thick, and more preferably less than approximately 35 mils thick and most preferably less than approximately 32 mils thick. As is indicated above, it is most preferable to render the wall approximately 30 mils thick, as this results in an approximately 30% lighter golf club shaft than comparably producible by the use of conventional wall structures and materials.

Figure 4:
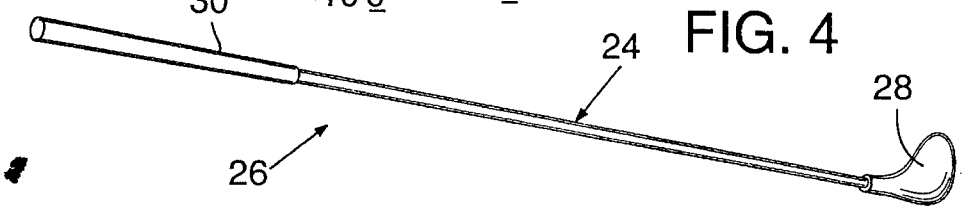
FIG. 4 is an isometric view of a golf club incorporating the invented shaft.

Turning finally to FIG. 4, a golf club 26 is shown as including, preferably, the invented shaft 24, a head 28 which may of course be of metal (so-called iron) or wood and a grip 30. Head 28 and grip 30 may be of any suitable design, construction, size and weight and yet invented shaft 24 may be used. This is because invented shaft 24 is suitable for any golf club application in that its unique structure maintains the lightness of the shaft while maintaining the low-torque, lightweight shaft's strength, e.g. in torsional and shear resistance, and flexural performance. Fifteen or more yards are added to a golfer's drive by using a golf club such as golf club 26 incorporating the invented shaft 24. Of course, it will be appreciated that the unique construction of shaft 24 commends it to incorporation in wedges and putters as well as drivers.

While the present invention has been shown and described with reference to the foregoing preferred embodiment, it will be apparent to those skilled in the art that other changes in form and detail may be made therein without departing from the spirit and scope of the invention as defined in the appended claims.

I claim:

1. A method for producing a hollow generally cylindrical golf club shaft, the method comprising:

forming on a generally horizontal work surface an elongate generally planar laminar substructure including first and second outer oppositely angularly biased fiber plies having interposed therebetween a first longitudinally oriented fiber ply;

laying a second longitudinally oriented fiber ply on one of the outer plies in substantially coextensive relationship therewith to form a laminar superstructure having no more than one surface-exposed biased fiber ply;

rolling such laminar superstructure to produce a generally cylindrical tube formed of the laminar superstructure wherein a second edge of the laminar superstructure overlaps an inner rolled region thereof;

heating said tube to a sufficient temperature to bond the plies thereof to one another; and smoothing an outer surface of said tube to produce a substantially circular generally cylindrical hollow shaft.

2. The method of claim 1, wherein said smoothing includes coating said tube with a polymer, curing such polymer and polishing such cured polymer.

3. The method of claim 1 which further comprises dimensioning said laminar substructure and said second longitudinally oriented fiber ply with sufficient width for said rolling to produce plural overlapping substantially concentric cross-sectionally circular coils of such superstructure.

4. A low-torque, lightweight golf club shaft comprising:

a generally cylindrical elongate tube of spirally wound and bonded laminar material including two or more angularly biased fiber plies separated over their surface areas by one or more longitudinally oriented fiber plies, an outermost one of said two or more angularly biased fiber plies being covered exteriorly by one or more longitudinally oriented fiber plies.

5. The shaft of claim 4, wherein at least one of said one or more longitudinally oriented fiber plies interposes any two of said two or more angularly biased fiber plies over the substantial spirally wound length of said laminar material.

6. The shaft of claim 4, wherein consecutive ones of said angularly biased fiber plies are oppositely and substantially equally angularly biased.

7. The shaft of claim 6, wherein said angularly biased and said longitudinally oriented fiber plies are graphite and wherein the wall of said tube is less than approximately 40 mils thick.

8. The shaft of claim 6, wherein the wall of said tube is less than approximately 35 mils thick.

9. The shaft of claim 6, wherein the wall of said tube is less than approximately 32 mils thick.

10. The shaft of claim 6, wherein said angularly biased and said longitudinally oriented fiber plies are of boron and wherein the wall of said tube is less than approximately 40 mils thick.

11. The shaft of claim 10, wherein the wall of said tube is less than approximately 35 mils thick.

12. The shaft of claim 10, wherein the wall of said tube is less than approximately 32 mils thick.

13. A golf club shaft formed from a laminar structure rolled into a generally cylindrical form, said laminar structure comprising:

a first angularly biased fiber ply of substantially planar flexible binder-containing sheet material of predefined elongate rectilinear shape;

a second angularly biased fiber ply of substantially planar flexible binder-containing sheet material of predefined elongate rectilinear shape, wherein said first and said second biased fiber plies are oriented such that their angular bias is substantially equal but opposite one another;

a first longitudinally oriented fiber ply of substantially planar flexible binder-containing sheet material of predefined elongate rectilinear shape, said first fiber ply lying in interposed relationship between said first and said second angularly biased fiber plies in substantially coextensive relationship therewith, a second longitudinally oriented fiber ply of substantially planar flexible binder-containing sheet material of predefined elongate rectilinear shape, said second longitudinally oriented fiber ply lying in coextensive relationship with one of said first and said second biased fiber plies;

said first and said second biased fiber plies each being bonded to said first longitudinally oriented fiber ply by heating to cause the binder to flow into interstitial gaps within the mating plies.

14. The golf club shaft of claim 13, wherein said laminar structure has an overall thickness of less than approximately 32 mils.

15. The golf club shaft of claim 14, wherein each of said plies is substantially approximately as thick as every other.

16. The golf club shaft of claim 13, wherein said bias plies are biased approximately perpendicularly to one another.

17. The golf club shaft of claim 13, wherein radially consecutive segments of said angularly biased plies are separated by a longitudinally oriented ply segment, whereby no first angularly biased ply contacts a second angularly biased ply.

* * * * *